United States Patent [19]

Proffer

[11] 4,428,606

[45] Jan. 31, 1984

[54] LATCHSET AND STRIKE ASSEMBLY FOR DOORS

[76] Inventor: Charles L. Proffer, P.O. Box 206, Gulfport, Miss. 39501

[21] Appl. No.: 280,840

[22] Filed: Jul. 6, 1981

[51] Int. Cl.[3] ..... E05C 1/02

[52] U.S. Cl. ..... 292/181

[58] Field of Search ..... 292/143, 177, 178, 179, 292/180, 181, 182, 191, 192, 153, 335

[56] References Cited

U.S. PATENT DOCUMENTS

| | | | |
|---|---|---|---|
| 1,203,394 | 10/1916 | Ottinger | 292/177 |
| 1,394,635 | 10/1921 | Maturo | 292/181 |
| 1,523,186 | 1/1925 | Elwell | 292/181 X |
| 1,850,516 | 3/1932 | Ross | 292/182 X |
| 2,188,642 | 1/1940 | Keats | 292/181 |
| 2,649,324 | 8/1953 | Kanell | 292/191 |

FOREIGN PATENT DOCUMENTS

| | | | |
|---|---|---|---|
| 877570 | 5/1953 | Fed. Rep. of Germany | 292/182 |

*Primary Examiner*—Gary L. Smith
*Assistant Examiner*—R. Illich
*Attorney, Agent, or Firm*—Clarence A. O'Brien; Harvey B. Jacobson

[57] ABSTRACT

A casing for support from the free swinging edge of a door is provided and a latch bolt is shiftably supported from the casing for movement between projected and retracted positions. The bolt is spring-biased toward the retracted position and a strike is further provided for stationary mounting on a frame member toward and away from the associated door and casing may swing to the closed and open positions, respectively. A bolt operator is shiftably supported from the casing for shifting between first and second positions and the bolt operator and bolt include coacting portions to positively shift the bolt to its projected position responsive to movement of the operator to its first position. The strike and bolt operator include coacting portions operative to shift the operator toward the first position responsive to final movement of the casing toward a closed position and spring-biased gate structure is supported from the casing for movement between applied and released positions and the gate structure is automatically shiftable to the applied position responsive to movement of the bolt to the projected position for preventing movement of the bolt from the projected position toward its retracted position. A bolt release is shiftably supported from the casing and may be shifted from an idle position to a release position for shifting the gate structure from its applied position to its release position.

5 Claims, 15 Drawing Figures

LATCHSET AND STRIKE ASSEMBLY FOR DOORS

BACKGROUND OF THE INVENTION

Locksets and/or latchsets of various different types heretofore have been provided for use for latching and/or locking the free swinging edge of a horizontally swingable door in the closed position and substantially all of these previously known forms of locksets and/or latchsets include latching bolts or locking bolts which are spring biased to projected positions and are cammed toward retracted positions upon final approach of the associated door to a closed position and thereafter allowed to shift toward the projected locking and/or latching positions with spring biased "snap action" as the associated door terminates its movement to the fully closed position.

Examples of locksets and/or latchsets of this type and including some of the general structural and operational features of the instant invention are disclosed in U.S. Pat. Nos. 26,296, 242,247, 3,257,135, 3,397,002 and 3,917,329.

However, the above aforementioned "snap action" causes a clearly audible "click" to be produced as the lock and/or latch bolt shifts to the projected position and the projecting lock and/or latch bolt portion, when the associated door is open, represents a hazard to personal safety.

SUMMARY OF THE INVENTION

The latchset and strike assembly of the instant invention is suitable for latching doors of buildings, hatches, accesses, and doors of vehicles, etc. The latchset does not in itself have, contain or constitute a key-locking device, but may be operatively associated with many different forms of key-locking or other security mechanisms.

The latchset of the instant invention is especially applicable to building hardware referred to by architects and in the builders trades as "finish hardware" or "builders hardware". However, it is applicable to various types of closures whether they be doors of aircraft, automobiles, or prison gates, and the like. Builders hardware for locksets and/or latchsets fall into three basic categories, including cylindrical, mortise and unit sets. Most all builders locksets/latchsets are composed of three basic components, including the bolt and its strike plate, the knob/shank and their bolt retracting parts, and the locking device, whether it be a key-operated or thumb-turn operated device or some combination thereof. As depicted, this invention is shown for adaptation to cylindrical lock/latchsets, but it is equally adaptable to full mortise and unit sets. Further, as a latching device, this invention is adaptable to panic exit devices as well as door hardware devices that use knobs, thumb pieces, thumb turns, push plates, push or pull plates and may be easily deactivated with small voltage, small current solenoids or electric magnets. The latter is most useful in detention and/or health care facilities wherein a door so equipped may be held in the fully closed position or fully open position and released by remote manual control or by automatic smoke/fire detection systems. By the same token, the instant invention may be used as a detention latch by merely using a double-acting solenoid to either retain or restrict movement of the latching cam to be explained more fully hereinafter.

This device uses a large latch bolt with a full $\frac{3}{4}''$ throw, standard to the industry. The bolt throw may be reduced by a simple change in dimension of one component so as to equal either $\frac{1}{2}''$ or $\frac{5}{8}''$ throw. Further, the instant invention is not primarily aimed to the home builder market. For ultimate security and fire rating, the device may be used in multiples on a door operated by a normally located lockset or latchset by use of cables or rods and a similar arrangement may also be used for panic exit devices.

The main object of this invention is to provide a lock-latchset of the type including a lock-latch bolt which is normally retracted, but which is fully projected to the lock and the latch position thereof responsive to the associated door completing its movement toward the fully closed position.

Another object of this invention is to provide a lock/latchset which may be utilized in conjunction with doors of standard thicknesses.

Another object of this invention is to provide a lock/latchset which is not "handed" and which may be readily mounted upon either a right hand or a left hand door merely by inverting the lock casing and strike.

Yet another important object of this invention is to provide a lock/latchset which may be used in combination with varius locking and unlocking mechanisms.

Another object of this invention is to provide a lock/latchset that is rugged, silent in operation and more vandalproof than the majority of presently available lock/latchsets.

Still another important object of this invention is to provide a lock/latchset which may be coupled to knob or handle sets, panic exit devices or actuated through the utilization of an electric solenoid, hydraulic or pneumatic plungers or electric magnets.

A final object of this invention to be specifically enumerated herein is to provide a lock/latchset in accordance with the preceding objects and which will conform to conventional forms of manufacture, be of simple construction and easy to install, so as to provide a device that will be economically feasible, long lasting and relatively trouble-free in installation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
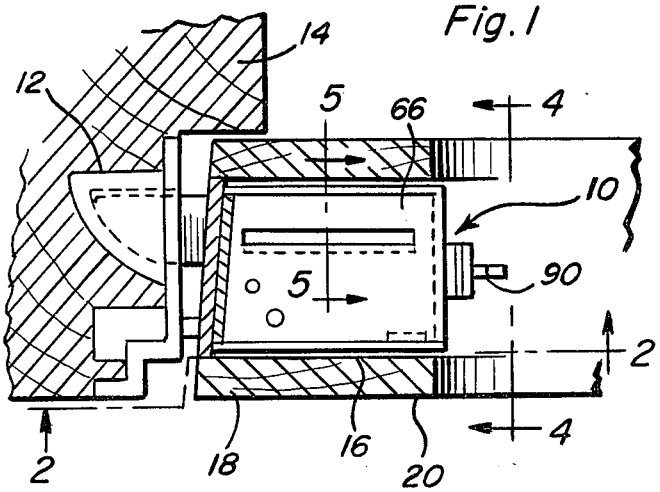
FIG. 1 is a fragmentary horizontal sectional view illustrating the lock/latchset of the instant invention in operative association with the free-swinging edge of a door and an adjacent door frame portion from which the strike of the set is supported.
Figure 3:
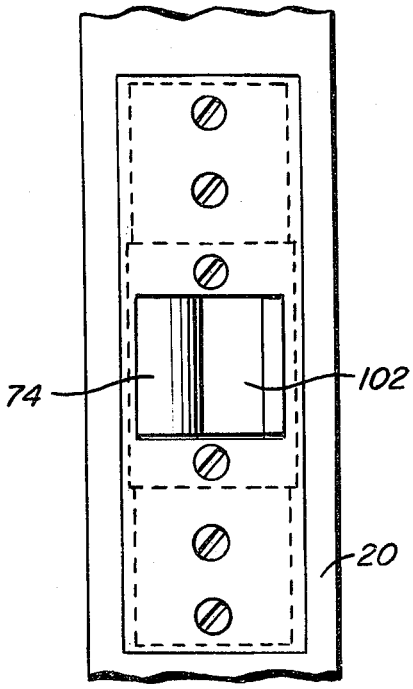
FIG. 3 is an edge elevational view of the door mounted assembly of the set as seen from the free-swinging edge of the associated door.

Referring now more specifically to the drawings, the numeral 10 generally designates the latchset and strike assembly of the instant invention. The assembly 10 includes a strike 12 suitably mounted in a door frame 14 and a casing 16 mounted in the free swinging edge portion 18 of a door 20. The casing 16 may be stamped as illustrated, forged, cast, or constructed of welded plate material, as desired. The casing 16 includes an open side 22 which may be closed by a front cover 24 suitably secured over the open side 22 through the utilization of fasteners (not shown) secured through openings 26 formed in the cover 24 and threadedly engaged in suitable threaded apertures 28 formed in mounting lug portions 30 of the case 16. The cover 24 includes a pair of vertically spaced laterally struck portions 32 behind which base arm portions 34 of a pair of leaf springs 36 (see FIG. 12) are anchored and the face edge of the front cover 24 includes a pair of vertically spaced right angularly disposed integral arms 38 having threaded apertures 40 formed therein centrally intermediate their opposite ends and carrying rearwardly directed mounting pins 42 at their free ends, see FIG. 14.

The rear wall 44 of the case 16 includes an inwardly offset portion 46 behind which the base arm 48 of a leaf spring 50 is anchored and the rear wall 44 further includes a central opening 51 formed therein for a purpose to be hereinafter more fully set forth.

The face end of the casing 16 includes a pair of upper and lower upwardly and downwardly directed mounting flanges 52 provided with smooth and threaded bores 54 and 56 formed therethrough and a face plate 58 is securable over the mounting flanges 52 through the utilization of fasteners (not shown) secured through bores 60 formed in the face plate 58 and threaded in the threaded bores 56. Additional fasteners (not shown) may be secured through bores 62 formed in the face plate and also through the smooth bores 54 formed in the mounting flanges 52 for securing the face plate and casing together and to the associated door.

The upper and lower walls 66 and 68 of the casing 16 include downwardly and upwardly directed guide flange portions 69 and have pairs of bores 70 and 71 formed therein.

Figure 5:
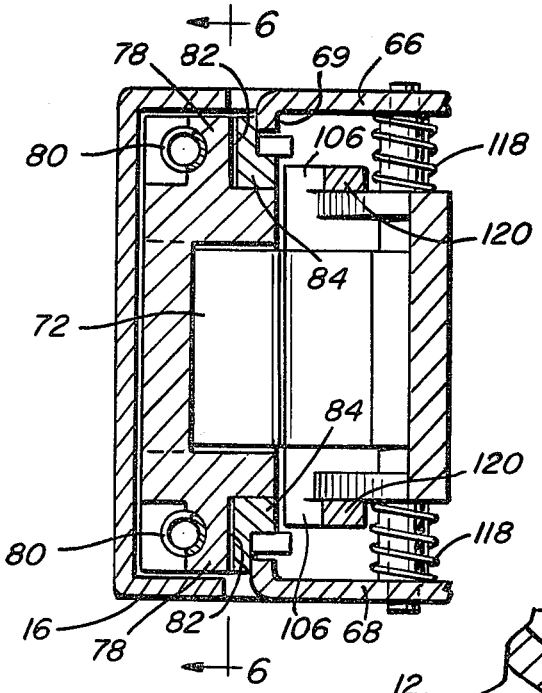
FIG. 5 is an enlarged fragmentary transverse vertical sectional view taken substantially upon the plane indicated by the section line 5—5 of FIG. 1.
Figure 7:
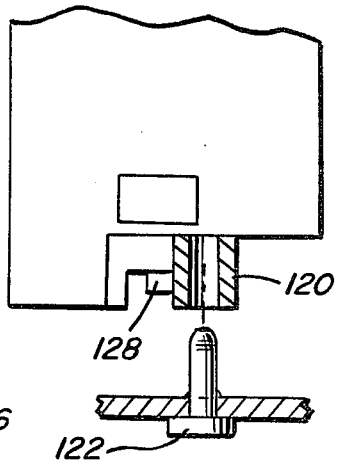
FIG. 7 is an exploded fragmentary sectional view illustrating the manner in which the bolt operator is pivotally supported from the casing of the latch/lockset.
Figure 7:
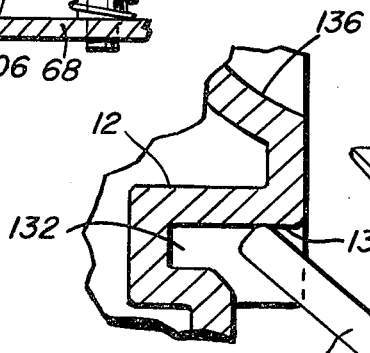
Figure 14:
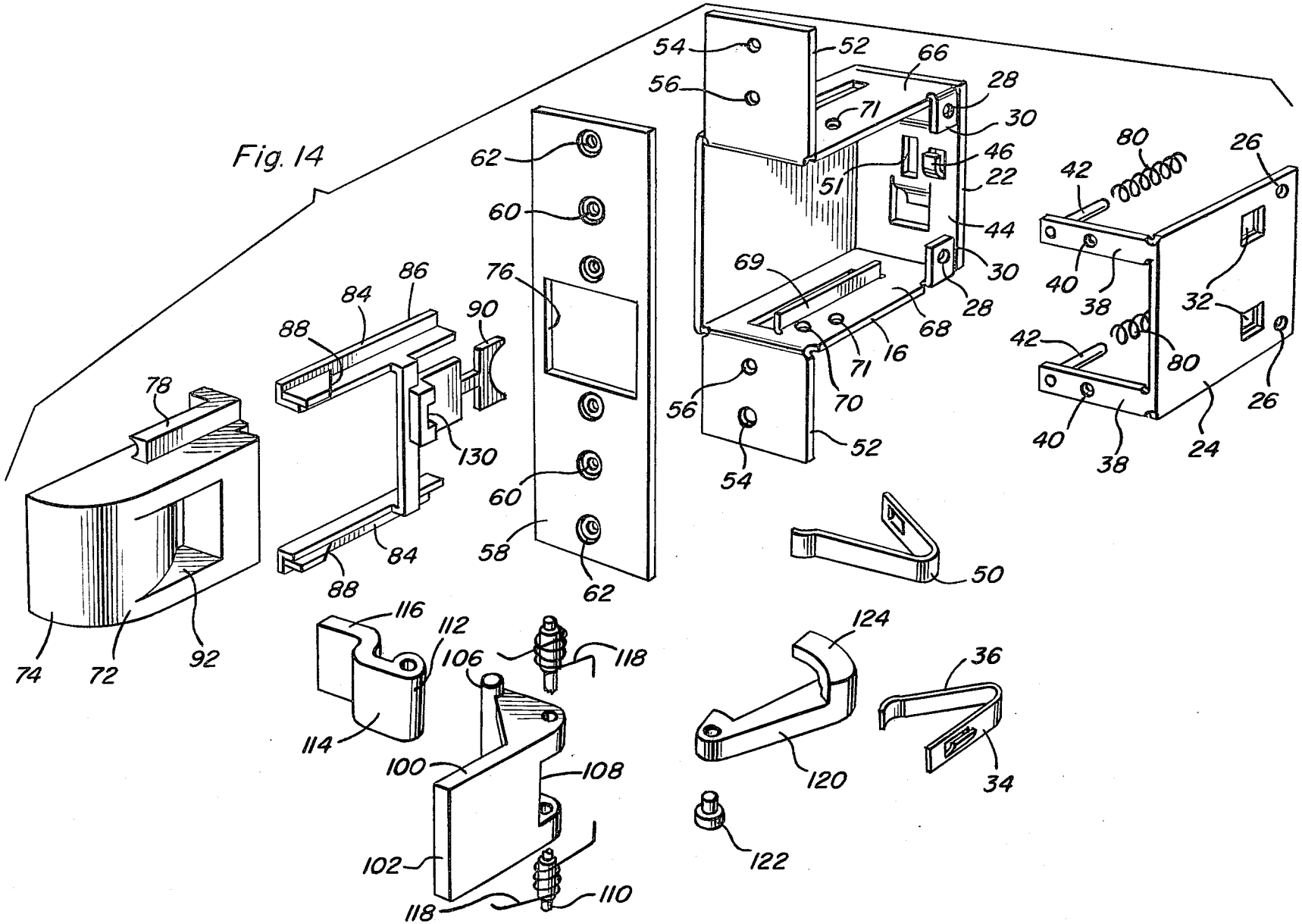
FIG. 14 is an exploded perspective view of the lock-/latchset with certain duplicated parts thereof omitted.

With attention now invited more specifically to FIGS. 5 and 14 of the drawings, it may be seen that the casing has a bolt 72 slidably mounted therein for projection and retraction of the radiused outer end 74 of the bolt 72 relative to the central opening 76 formed in the face plate 58. The upper and lower surfaces of the bolt 72 include compression spring seats and guides 78 and one pair of corresponding ends of a pair of compression springs 80 are seated in the seats and guides 78. The upper and lower surfaces of the bolt 72 disposed on the sides of the seats and guides 78 remote from the springs 80 define guideways 82 which slidingly and guidingly support upper and lower horizontal portions 84 of a bolt release assembly referred to in general by the reference numeral 86. The upper and lower portions 84 include upper and lower cam surfaces 88 and the rear of the bolt release assembly includes a rearwardly projecting tongue 90 receivable through the opening 51 in the rear wall 44 and which may be engaged and operated by any conventional knob and shank assembly and bolt retracting parts.

With attention now invited more specifically to FIGS. 5, 7, 8, 9 and 14, it may be seen that the bolt 72 includes a lateral opening 92 formed therethrough and that the opening 92 is disposed between opposing upstanding abutment surfaces 94 and 96. A bolt operating assembly referred to in general by the reference numeral 98 is provided and includes a bell crank 100 having first and second right angularly disposed arms 102 and 104, the arm 104 including upper and lower pin portions 106. The bell crank 100 has a mid-height opening 108 formed therein at the juncture of the arms 102 and 104 and is supported between the walls 66 and 68 of the casing 16 by a pivot shank 110 whose upper and lower ends are sleeved and received in the bores 71. The pivot shank 110 also extends through a sleeve portion 112 carried by one end of an elongated operating tongue 114 including a laterally offset terminal end 116 on its other end, the sleeve portion 112 being received in the opening 108. A pair of butterfly springs 118 are disposed about the pivot shank 110 and are engaged with the front cover 24 of the casing 16 and the arm 104 to yieldingly bias the bell crank 100 in a clockwise direction as viewed in FIGS. 8-12 and 14.

Figure 10:
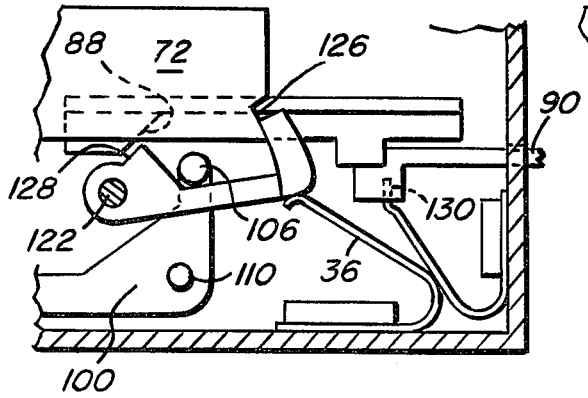
FIGS. 10, 11 and 12 comprises fragmentary horizontal sectional views illustrating alternate relative positions of the bolt, the bolt operator and the bolt movement limiting gate member or latch as well as the bolt-latch release or slide.
Figure 11:
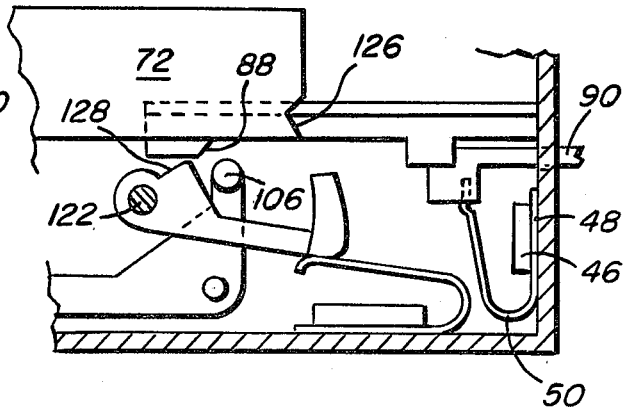
Figure 12:
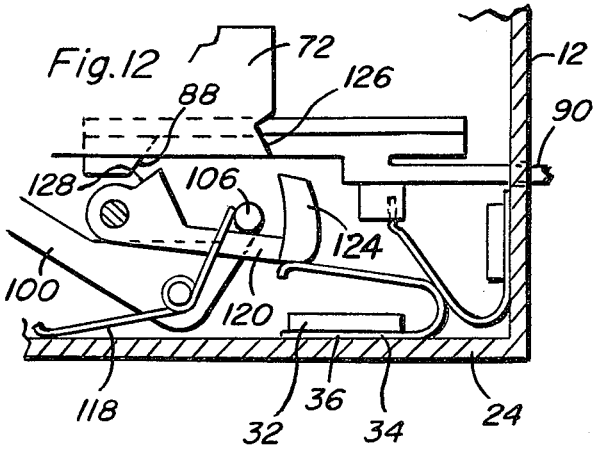
Figure 13:
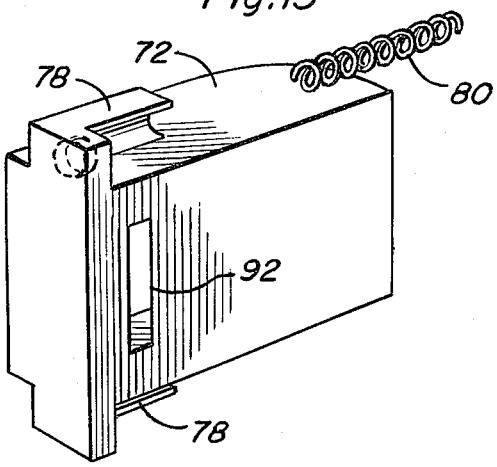
FIG. 13 is a perspective view of the bolt and one of the bolt retracting springs.

A pair of bolt gate or latch members 120 are pivotally supported from pivot fasteners 122 secured through the bores 70 and include arcuate tongue portions 124 swingable behind arcuate abutment surfaces 126 see FIGS. 10, 11 and 12 formed in the rear end of the bolt 72. In addition, the bolt gate or latch members 120 include cam surfaces 128 engageable by the cam surfaces 88 defined on the upper and lower portions 84 of the assembly 86. The springs 36 engage the free ends of the members 120 and the free end of the spring 50 is engaged in a recess 130 formed in the assembly 86, see FIGS. 10, 11, 12 and 14.

Figure 15:
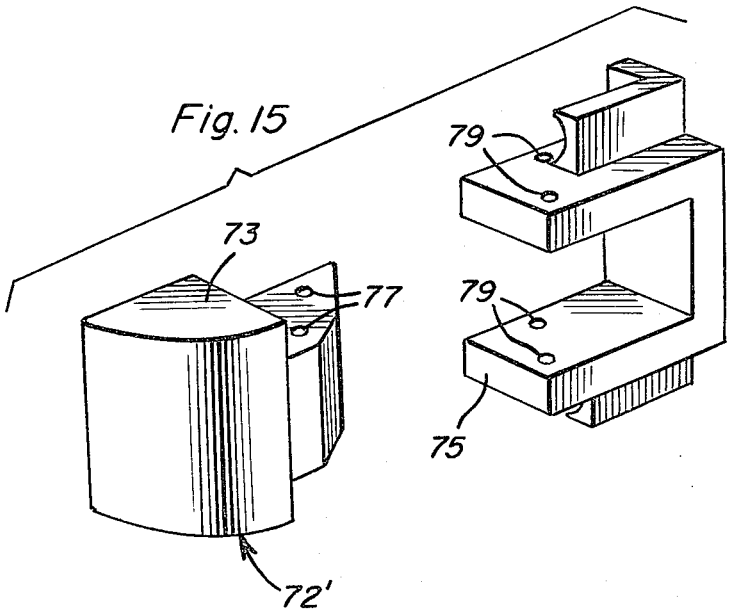
FIG. 15 is an exploded perspective view of a two-piece bolt which may be utilized in lieu of the one-piece bolt illustrated in FIG. 13.

The forward ends of the springs 80 are telescoped over the pins 42 and the bolt 72 may be replaced by a two-piece bolt referred to in general by the reference numeral 72′ including forward and rearward end portions 73 and 75 secured together through the utilization of pins (not shown) passed through corresponding registered bores 77 and 79 formed in the portions 73 and 75, see FIG. 15. Also, it will be noted from FIG. 5 of the drawings that the guide flanges 69 guidingly engage the sides of the upper and lower portions 84 remote from the combined seats and guides 78. Also, the strike 12 is of the integral dust box type, but may be of the stamped dust cover type, the free end of the arm 102 being seatingly receivable in the recess 132 of the strike 12, see FIG. 8.

Figure 8:
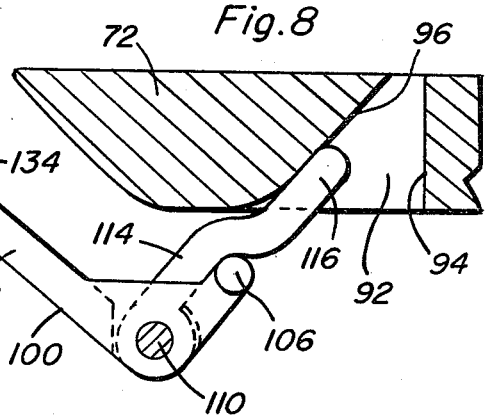
FIG. 8 is a schematic view partially in section illustrating the manner in which the bolt operator is positioned for engagement with the strike immediately prior to closing of the associated door for the purpose of projecting the bolt upon final movement of the door to its closed position.
Figure 6:
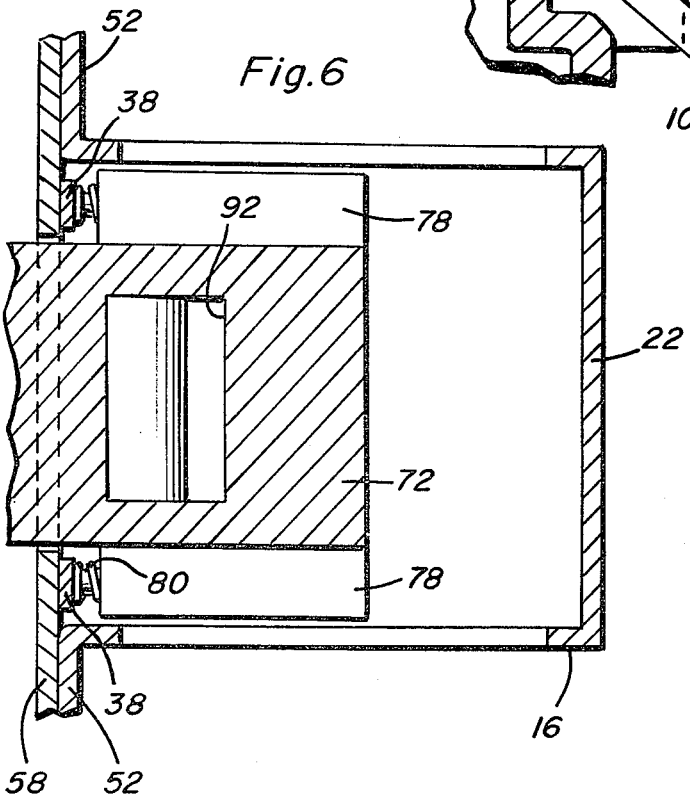
FIG. 6 is a vertical sectional view taken substantially upon the plane indicated by the section line 6—6 of FIG. 5.
Figure 9:
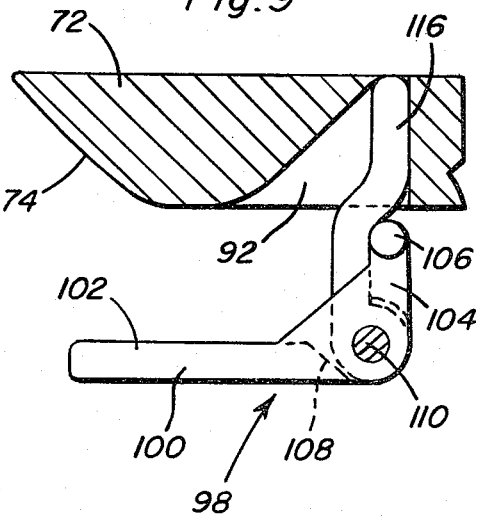
FIG. 9 is a view similar to FIG. 8, but with the bolt in a projected position.

As the door 20 swings toward the closed position thereof illustrated in FIG. 1, the free end of the arm 102 first strikes the abutment surface 134 of the strike 12 leading into the recess 132 as illustrated in FIG. 8. Continued movement of the door 20 toward the closed position thereof illustrated in FIG. 1 causes the bell crank 100 to pivot about the pivot shank 110 in a counterclockwise direction and therefore the terminal end 116 of the operating tongue 114 to swing to the left as viewed in FIG.8 to begin projection of the bolt 72 from the door edge and into the bolt receiving recess 136 formed in the strike 12. As the door 20 moves to its final closed position, the free end of the arm 102 is substantially fully received in the recess 132 in position substantially paralleling the abutment surface 134 and the bolt 72 is projected into the recess 136 as shown in FIG. 1. As the bolt 72 is fully projected, the spring biased bolt gate or latch members 120 swing from the retracted positions thereof illustrated in FIG. 12 to positions with the tongue portions 124 thereof slidably engaged with the near side of the bolt 72 and final movement of the bolt 72 to the projected position aligns the abutment surfaces 126 with the tongue portions 124 and thus allows the latter to swing in behind the abutment surfaces 126 in the manner illustrated in FIG. 10 of the drawings. Accordingly, the bolt 72 is locked against retraction relative to the free swinging edge of the door 20. Further, the arm 102 shields the corresponding side of the bolt 72 as a further security measure.

Figure 2:
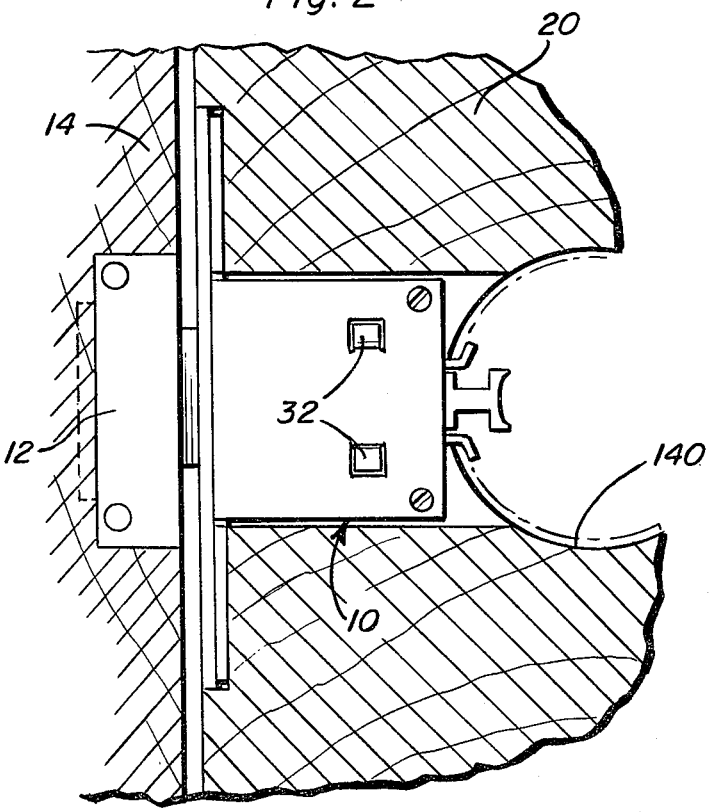
FIG. 2 is a fragmentary vertical sectional view taken substantially upon the plane indicated by the section line 2—2 of FIG. 1.
Figure 4:
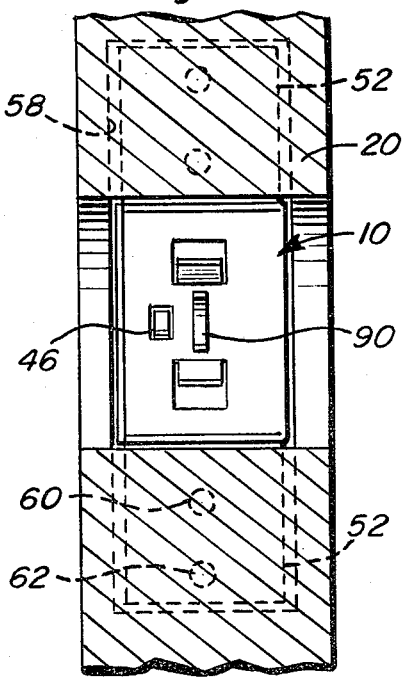
FIG. 4 is a fragmentary vertical sectional view taken substantially upon the plane indicated by the section line 4—4 of FIG. 1.

If a knob set 140, such as that illustrated in FIG. 2 of the drawings, is operatively associated with the door and the tongue 90, rotation of the knob set 140 will cause rearward displacement of the assembly 86 whereupon the cam surfaces 88 will engage the cam surfaces 128 and pivot the bolt gate or lock members 120 from engagement with the abutment surface 126 in the manner illustrated in FIG.11 of the drawings, whereupon the compression springs 80 will automatically retract the bolt 72. Further, the springs 118 bias the bell crank 100 with a sufficient force to enable the pins 106 to retract the bolt gate or lock members 120 against the biasing action of the weaker springs 36. Further, by providing a lost motion connection between bell crank 100 and operating tongue 114, the bell crank 100, if playfully tampered with while the door 20 is in the open position, may be swung from the position of FIG. 8 to the position of FIG. 9 causing the bolt 72 to be extended and automatically latched by gate members 120 in the extended position. However, upon release of the bell crank 100 the springs 118 will return the bell crank 100 to the position shown in FIGS. 8 and 12 and pin portions 106 will swing the gate members 120 from the bolt latching positions of FIG. 10 to the release positions of FIG. 12 allowing springs 80 to retract bolt 72.

It is to be readily appreciated that any suitable form of actuator may be provided for the bolt release assembly 86. Such an actuator may include the knob set 140, a solenoid, a fluid pressure actuator, or an electromagnet. Accordingly, the bolt release assembly 86 may be remotely actuated.

It will be noted that both the casing 16 and the strike 12 may be inverted in order to operatively associate the assembly 10 with a door hinged on the opposite side. Further, the assembly 10 may be incorporated into a full mortise type lockset and such a modification could include a knob shaft, keying device, stop work buttons, dead lock devices, escutcheons, knobs, and the like. Similarly, the assembly can very well be incorporated into a unit set.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A lock for latching a door, comprising in combination: a casing, a latch bolt shiftably supported from the casing for movement between projected and retracted positions relative to said casing, force means operatively connected between said casing and latch bolt yieldingly biasing the latter toward the retracted position, a strike for mounting stationarily relative to a frame member toward and away from a closed position adjacent said strike said casing may be moved when door mounted, a bolt operator shiftably supported from said casing for shifting between first and second positions relative to said casing, said bolt operator and bolt including coacting portions operative to positively shift said bolt toward said projected position responsive to movement of said operator to said first position and to allow retraction of said bolt toward said retracted position responsive to movement of said operator to said second position, said strike and bolt operator including coacting portions operative to shift said operator toward said first position responsive to final movement of said casing toward said closed position, releasable gate means shiftably supported from said casing for movement between applied and release positions, means yieldingly biasing said gate means to said applied position, said gate means being automatically shiftable to said applied position responsive to movement of said bolt to said projected position and operative, when in said applied position, to prevent movement of said bolt from said projected position toward said retracted position, and a bolt release shiftably supported from said casing for shifting between idle and release positions and operative, when shifted from said idle position to said release position, to shift said gate from said applied position to said release position and to thereby allow said force means to shift said bolt from said projected position to said retracted position, said bolt operator including first and second relatively shiftable components and coacting portions establishing a one-way connection between said first and second components, said first component being engageable with said strike and said second component being engaged with said bolt, means yieldingly biasing said first component to the ready position assumed when said bolt is in said retracted position, said first component and gate means including means operative to shift said gate means from said applied position to said release position responsive to movement of said first component to said ready position.

2. The lock of claim 1 wherein said bolt release is shiftably supported from said casing for rectilinear shifting in a path generally paralleling the path of shifting movement of said latch bolt relative to said casting.

3. A lock for latching a door, comprising in combination: a casing, a latch bolt shiftably supported from the casing for movement between projected and retracted positions relative to said casing, force means operatively connected between said casing and the latch bolt yieldingly biasing the latter toward the retracted position, a strike for mounting stationarily relative to a frame member toward and away from a closed position adjacent said strike said casing may be moved when door mounted, a bolt operator shiftably supported from said casing for shifting between first and second positions relative to said casing, said bolt operator and bolt including coacting portions operative to positively shift said bolt toward said projected position responsive to movement of said operator to said first position and to allow retraction of said bolt toward said retracted position responsive to movement of said operator to said second position, said strike and bolt operator including coacting portions operative to shift said operator toward said first position responsive to final movement of said casing toward said closed position, releasable gate means shiftably supported from said casing for movement between applied and release positions, and means operatively connected between said gate means and casing for releasably shifting said gate means to said applied position responsive to movement of said bolt to said projected position, said gate means when in said applied position being operative to prevent movement of said bolt from said projected position toward said retracted position, said bolt operator including articulated bell crank means having first and second relatively angulated and swingable arms, bell cranks means being pivotally mounted from said casing for oscillation about an upstanding axis, said first and second arms being engageable with said strike and bolt, respectively, to project said bolt to the projected position upon final movement of said door to the closed position, said arms being relatively swingable between maximum and minimum included angle defining positions, means yieldingly biasing said arms towards said maximum included angle defining positions, said coacting portions of said bolt operator and bolt comprising an abutment surface of said bolt and one of said arms, the other of said arms being abuttingly engageable with said strike upon final movement of said door to the closed position.

4. In the combination of a door jamb portion including a strike and a door having a free edge portion shiftable toward and away from said strike and jamb portion to close and open said door and wherein said free edge portion of said door supports a bolt for shifting between projected and retracted positions and said bolt, when in said projected position and said door is in the closed position, is operatively engaged with said strike to prevent movement of said door from the closed position toward the open position, means yieldingly biasing said bolt to said retracted position, belt projection means shiftably supported from said door free edge portion and engageable with said strike and operatively connected with said bolt for positively shifting said bolt from the retracted position to the projected position responsive to final movement of said free edge portion toward the position thereof when said door is fully closed, and latch means supported from said free edge portion and operatively associated with said bolt for automatically latching said bolt in said projecting position responsive to movement of said bolt from said retracted position to said projected position, belt release means shiftably supported from said door for shifting between idle and release positions and operative, when shifted from said idle position to said release position, to shift said latch means from the applied position to said release position and to thereby allow said bolt to be yieldingly biased from said projected position to said retracted position, said bolt projection means including articulated bell crank means having first and second relatively angulated and swingable arms, said bell crank means being pivotally mounted from said free edge portion for oscillation about an axis generally paralleling the free swinging edge, said first and second arms being engageable with said strike and bolt, respectively, to project said bolt to the projected position upon final movement of said door to the closed position, said arms being relatively swingable between maximum and minimum included angle defining positions, and means yieldingly biasing said arms toward said maximum included angle defining positions.

5. A lock for latching a door, comprising in combination: a casing, a latch bolt shiftably supported from the casing for movement between projected and retracted positions relative to said casing, force means operatively connected between said casing and the latch bolt yieldingly biasing the latter toward the retracted position, a strike for mounting stationarily relative to a frame member toward and away from a closed position adjacent said strike said casing may be moved when door mounted, a bolt operator shiftably supported from said casing for shifting between first and second positions relative to said casing, said bolt operator and bolt including coacting portions operative to positively shift said bolt toward said projected position responsive to movement of said operator to said first position and to allow retraction of said bolt toward said retracted position responsive to movement of said operator to said second position, said strike and bolt operator including coacting portions operative to shift said operator toward said first position responsive to final movement of said casing toward said closed position, releasable gate means shiftably supported from said casing for movement between applied and release positions, and means operatively connected between said gate means and casing for releasably shifting said gate means to said applied position responsive to movement of said bolt to said projected postion, said gate means when in said applied position being operative to prevent movement of said bolt from said projected position toward said retracted position, said bolt operator including first and second relatively shiftable components and coacting portions establishing a one-way connection between said first and second components, said first component being engageable with said strike and said second component being engaged with said bolt, means yieldingly biasing said first component to the ready position assumed when said bolt is in said retracted position, said first component and gate means including means operative to shift said gate means from said applied position to said release position responsive to movement of said first component to said ready position.

* * * * *